US007434316B2

(12) United States Patent
Nenadic

(10) Patent No.: US 7,434,316 B2
(45) Date of Patent: Oct. 14, 2008

(54) FIXED KNIFE AND KNIFE SHEATH

(75) Inventor: John P. Nenadic, Vancouver, WA (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

(21) Appl. No.: 11/435,231

(22) Filed: May 16, 2006

(65) Prior Publication Data

US 2007/0266569 A1 Nov. 22, 2007

(51) Int. Cl.
*B25F 1/00* (2006.01)
*B26B 29/02* (2006.01)

(52) U.S. Cl. ..... 30/143; 7/167

(58) Field of Classification Search ..... 7/118, 7/167; 30/123, 143, 151–164, 335; 81/3.35, 81/177.2, 177.6; 132/143, 76.2, 328; 224/232
See application file for complete search history.

(56) References Cited

U.S. PATENT DOCUMENTS

| | | | | |
|---|---|---|---|---|
| 2,391,574 | A | 12/1945 | Housinger | |
| 2,793,434 | A | 5/1957 | Wigington | |
| 4,226,020 | A | 10/1980 | Quenot et al. | |
| 4,404,747 | A | 9/1983 | Collins | |
| 4,414,744 | A | 11/1983 | Collins | |
| 4,523,379 | A * | 6/1985 | Osterhout et al. | 30/151 |
| 4,558,516 | A | 12/1985 | Collins | |
| 4,726,498 | A | 2/1988 | Esposito | |
| 4,827,614 | A | 5/1989 | Mitchell | |
| 4,854,044 | A | 8/1989 | Collins | |
| 4,856,192 | A | 8/1989 | Collins | |
| 4,961,523 | A | 10/1990 | Stimac | |
| 4,998,350 | A | 3/1991 | Thompson | |
| 5,067,239 | A | 11/1991 | Collins | |
| 5,092,046 | A | 3/1992 | Collins | |
| 5,123,167 | A * | 6/1992 | Kelley | 30/151 |
| 5,138,768 | A | 8/1992 | Collins | |
| 5,155,911 | A | 10/1992 | Collins | |
| 5,163,592 | A | 11/1992 | Newton et al. | |
| 5,255,436 | A | 10/1993 | Yoshida | |
| 5,297,341 | A | 3/1994 | Collins | |
| 5,379,520 | A | 1/1995 | Collins | |
| 5,511,311 | A * | 4/1996 | Collins | 30/162 |
| 5,572,793 | A | 11/1996 | Collins et al. | |

(Continued)

FOREIGN PATENT DOCUMENTS

| | | |
|---|---|---|
| DE | 296 03 952 U1 | 3/1996 |

(Continued)

*Primary Examiner*—Timothy V Eley
(74) *Attorney, Agent, or Firm*—Douglas G. Anderson

(57) ABSTRACT

A locking sheath and knife combination is provided that includes a spring biased member that partially extends out of the handle of the knife and interacts with a catch on the sheath for securing the knife to the sheath. When the user wants to extract the knife from the sheath, the spring biased member is squeezed as the handle is grabbed, which rotates the spring biased member to be substantially fully contained within the handle of the knife, and is secured there by the lock spring plate. When the knife is inserted back into the sheath, a protrusion on the sheath interacts with the lock spring plate to automatically allow the spring biased member to rotate out of the handle, thereby securing the knife to the sheath.

5 Claims, 4 Drawing Sheets

U.S. PATENT DOCUMENTS

| | | | | |
|---|---|---|---|---|
| 5,647,130 | A | 7/1997 | Collins | |
| 5,794,347 | A | 8/1998 | Serpa | |
| 5,915,793 | A | 6/1999 | Serpa | |
| 5,926,959 | A | 7/1999 | Collins | |
| 6,085,423 | A | 7/2000 | Marifone | |
| 6,293,448 | B1 | 9/2001 | Pietrusynski | |
| 6,427,333 | B1 | 8/2002 | Veltz et al. | |
| 6,442,843 | B1 * | 9/2002 | Jue et al. | 30/151 |
| D465,542 | S | 11/2002 | Bloch | |
| 6,817,499 | B2 | 11/2004 | Martinez | |
| 6,981,290 | B2 | 1/2006 | Terzuola | |
| 2003/0093100 | A1 | 5/2003 | Robinson | |
| 2003/0126746 | A1 | 7/2003 | Yu | |

FOREIGN PATENT DOCUMENTS

| | | | |
|---|---|---|---|
| DE | 195 45 758 | A1 | 6/1996 |
| EP | 0 525 300 | B1 | 7/1995 |
| FR | 2 818 036 | | 12/2000 |
| WO | WO 96/06571 | | 3/1996 |

* cited by examiner

FIXED KNIFE AND KNIFE SHEATH

BACKGROUND OF THE INVENTION

This invention relates generally to a combination locking sheath and knife, and more specifically, a knife that can be easily extracted from the sheath for use.

When carrying a fixed-blade knife, it is typically desired that the knife blade be retained within a sheath or scabbard at all times the knife is not in use. Furthermore, since fixed-blade knives are typically carried and used in dynamic activities such as hunting, SCUBA diving, sky diving and other such activities, it is desirable to have the fixed-blade knife secured to the sheath such that the knife will not be lost, and more importantly that the knife will not inadvertently exit the sheath and injure the carrier or others in close proximity and will not damage any gear.

There do remain instances, however, where extraction of the knife from the sheath very quickly and easily is of paramount importance. Such instances may include, for example, a sky diver having to cut himself free from a tangled parachute, or a SCUBA diver getting entangled in fishing lines from a passing boat.

The need for securing a knife to a sheath was recognized long before any patent system was developed, and was originally accomplished by simply tying the knife to the sheath with a leather strap. The leather strap was eventually given a snap to make it faster and more user-friendly.

In more recent years, locking mechanisms have included such ideas as a rubber ring that is stretched over the handle of the knife, which is particularly common in SCUBA diving knives, as well as spring biased levers, latches, or buttons. The spring biasing devices have been located on either the knife handle or on the sheath. In either case however, the spring-biased device springs back to its original position upon releasing the knife from the sheath. In the case where the spring-biased device is on the knife, there exists potential for the spring-biased device to interfere with the interaction between the user's hand and the knife such that comfort, safety, and usefulness are hindered. It is also typical for the spring-biased device to be physically located in such a place and manner that one or more fingers are required to perform dexterous tasks in order for the locking mechanism to be disengaged.

What is needed, therefore, is a knife that can be securely locked into a sheath when not in use, yet requires no additional action other than gripping the knife in a normal use position to release the locking mechanism, without sacrificing comfort, safety, and usefulness.

SUMMARY OF THE INVENTION

It is therefore an object of the present invention to provide a locking knife and sheath combination which allows for automatic locking of the knife to the sheath upon insertion therein, and which allows for quick and easy unlocking of the knife from the sheath by simply grasping the knife firmly by the handle in preparation for normal knife use.

It is another objective of the invention to provide a locking knife and sheath combination wherein upon extraction of the knife from the sheath, the knife is free from unrestrained spring biasing members that may interfere with comfort, safely, and usefulness of the knife.

Generally, the present invention includes a fixed blade knife having an elongated blade and a tang end. The tang end of the knife has scales on each side to form the knife handle, with the tang end being placed at the top of the scales. A spring-assisted release lever is pivotally mounted between the scales below the blade tang, and rotates partially out of the handle bottom end where the blade transitions into the tang; the spring urging the release lever to rotate out of the handle. A spring-assisted release lever retainer is incorporated into one scale beside the blade tang, and secures the release lever within the scales of the handle when the knife is extracted from the sheath such that the release lever does not interfere with the use or feel of the handle. When the knife is inserted into the sheath, an interface plate protrusion on the sheath interacts with a lock spring plate, thereby allowing the release lever to rotate partially out of the handle and interact with a catch on the sheath to secure the knife into the sheath.

DETAILED DESCRIPTION OF EMBODIMENTS OF THE INVENTION

The present invention now will be described more fully hereinafter with reference to the accompanying drawings in which some but not all embodiments of the invention are shown. Indeed, this invention may be embodied in many different forms and should not be construed as limited to the embodiments set forth herein. Like numbers refer to like elements throughout.

Figure 1:
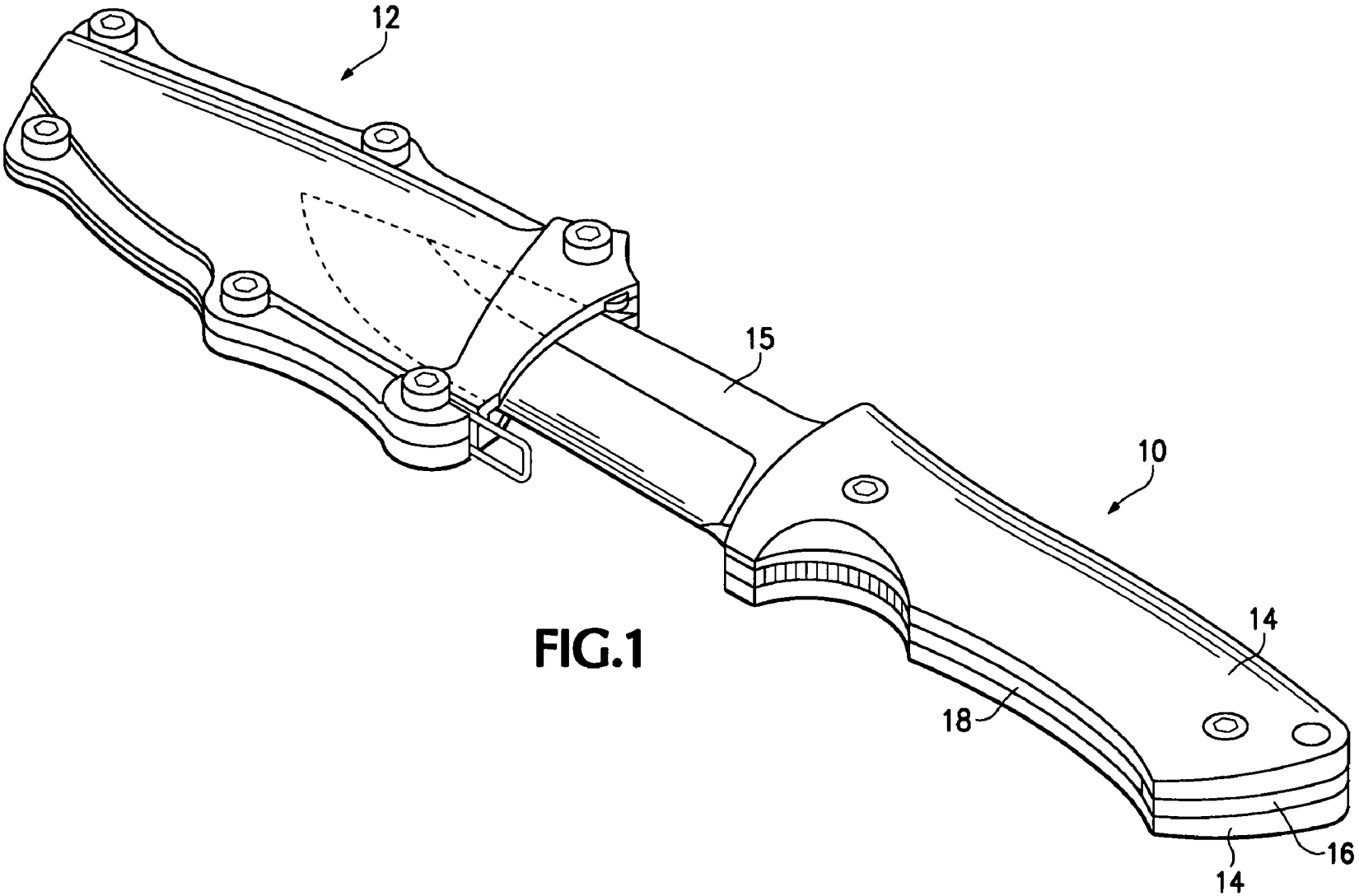
FIG. 1 is a perspective view of a locking knife and sheath combination in accordance with the present invention, where the knife is partially inserted into the sheath.
Figure 2:
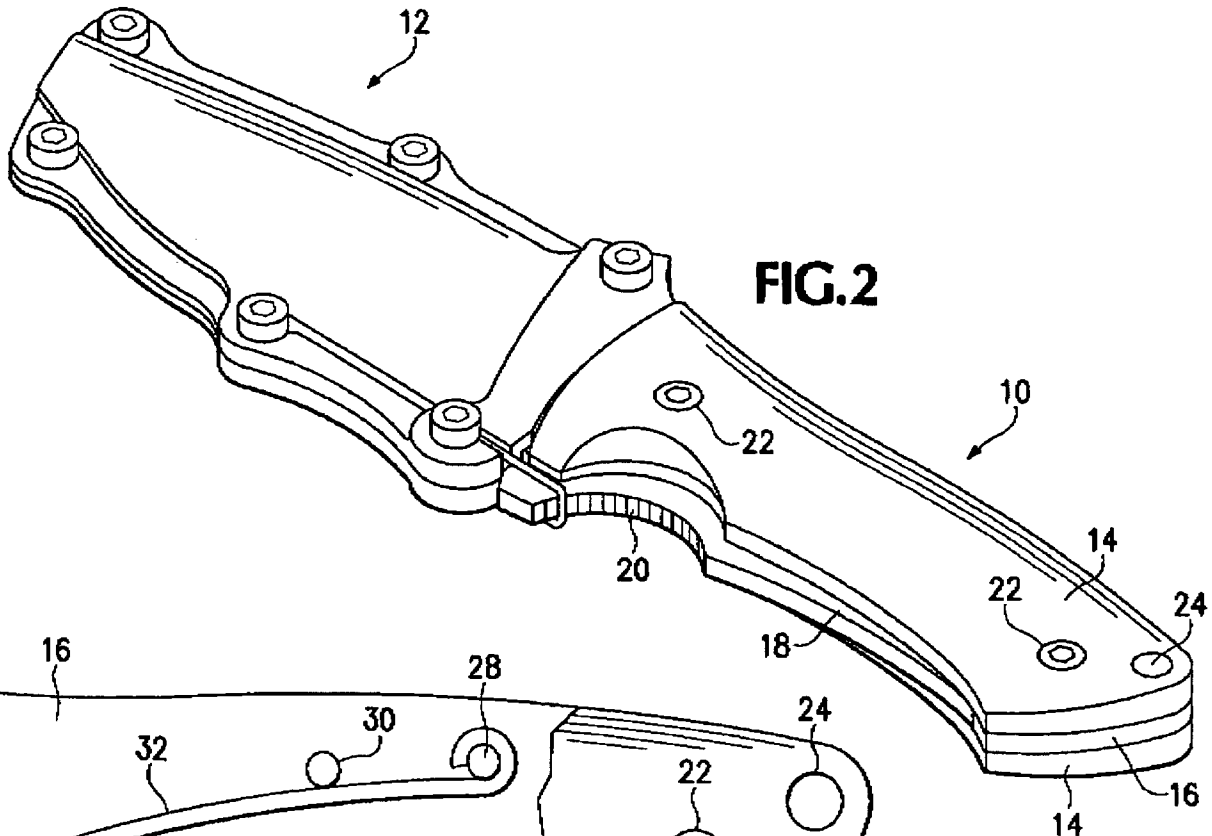
FIG. 2 is a perspective view of the locking knife and sheath of FIG. 1, with the knife inserted fully into the sheath.

As shown in FIGS. 1 and 2, a knife, generally shown as 10, interacts by insertion of knife blade 15 into a sheath 12. The sheath 12 can be made of any number of natural or synthetic materials such as leather, plastic, glass filled nylon, wood, metal, etc. Although not shown, the sheath may have a belt loop, MOLLE straps, leg straps, or other means known in the art for securing the sheath to user. The sheath may be formed of one solid piece of material by such means as injection molding, casting, carving, or the like, or may be made of more than one piece, and attached by fasteners 62, which may be screws, bolts, pins, rivets, glue, or other mechanical or chemical fasteners known in the art. The sheath also contains at least one interface plate protrusion 60, and spring catch 58, both of which will be discussed hereinafter.

The knife 10 may be comprised of a blade 15 at one end that translates in the medial portion of the knife to a blade tang 16 at the other end. Generally, the blade 15 and the blade tang 16 are made from a single piece of metal. Scales 14 may be attached to the blade tang 16 through fastener holes 21 via fasteners 22 to form a handle, and may be manufactured out of natural or synthetic materials. Fasteners 22 again may be screws, rivets, bolts, or other mechanical fasteners as known in the art. Optionally, a lanyard hole 24 may extend through the scales 14 and blade tang 16 for receiving a lanyard.

Figure 3:
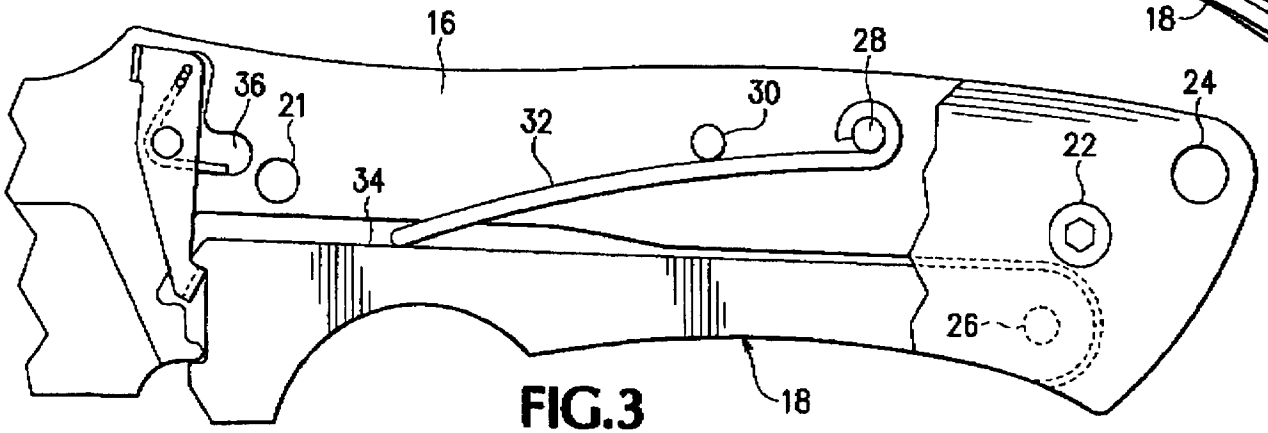
FIG. 3 is a partial cutaway view of the tang end of the locking knife of FIG. 1, showing a release lever retracted into a handle cavity of the locking knife and secured by a release lever retainer.

The inside walls of scales 14, or in other words the walls of the scales 14 that contact the blade tang 16 have voids for receiving and encasing other mechanical parts. As can best be seen in FIG. 3, a spring release lever 18 pivots around a spring release axle 26 secured in the distal end of the scales 14. The release axle 26 may be encapsulated within the scales 14 as shown, or may extend through scales 14, and may in effect function as both an axle and a fastener. A spring 32 is secured to a spring axle 28 at the distal end, and rests upon the spring interaction surface 34 of the spring release lever 18 as shown. The spring axle 28 again may be encased by one or both scales 14 as shown, or may extend through the scales 14 and act as a fastener. A spring resistor 30 is positioned along the spring 32 to urge the spring 32, and therefore the spring release lever 18, away from the medial portion of the blade tang 16, which would be counterclockwise around spring release axle 26 as shown in FIG. 3.

Figure 5:
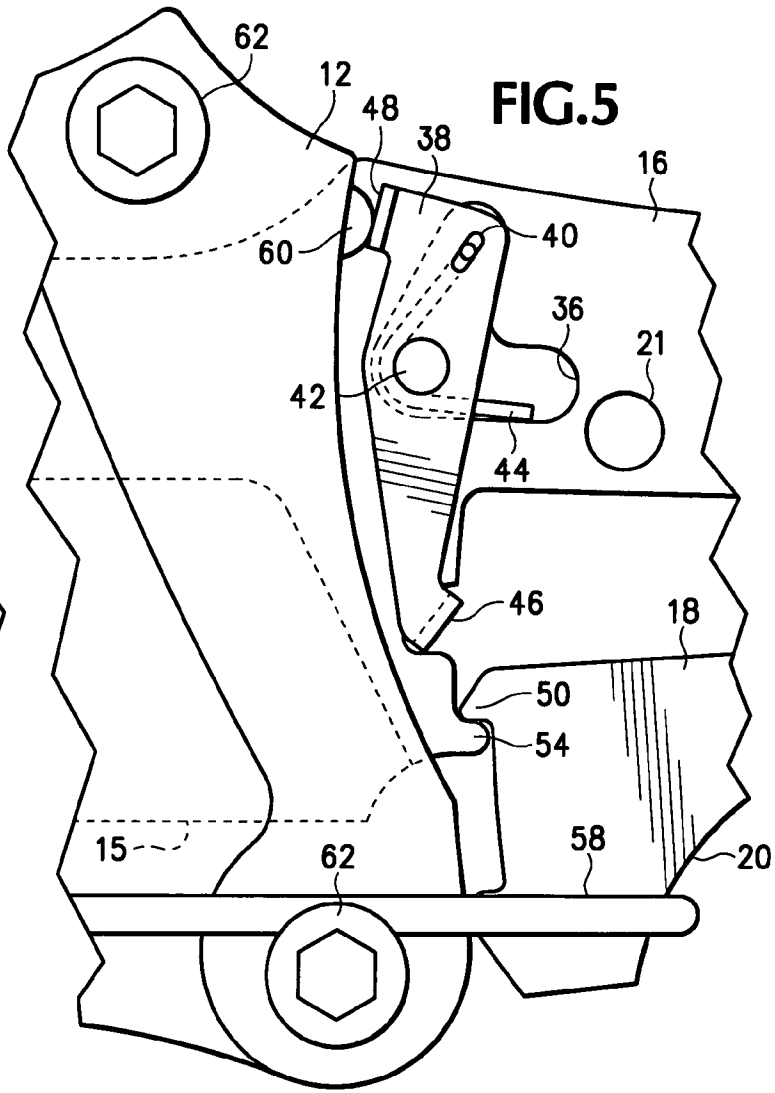
FIG. 5 is a partial cutaway view of the central portion of the locking knife and sheath of FIG. 1, showing a release lever extended out of the handle and interacting with the sheath.
Figure 4:
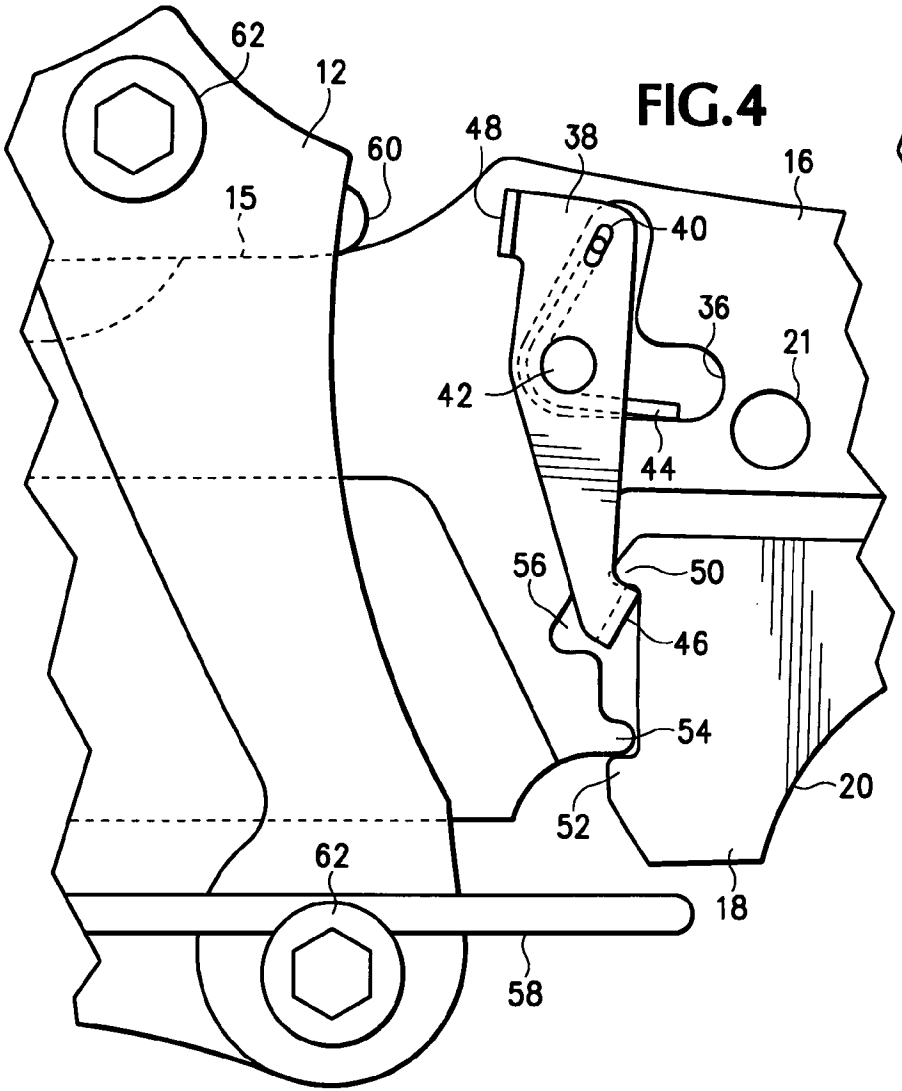
FIG. 4 is a partial cutaway view of the central portion of the locking knife and sheath of FIG. 1, showing a release lever secured within the handle cavity of the locking knife.
Figure 6:
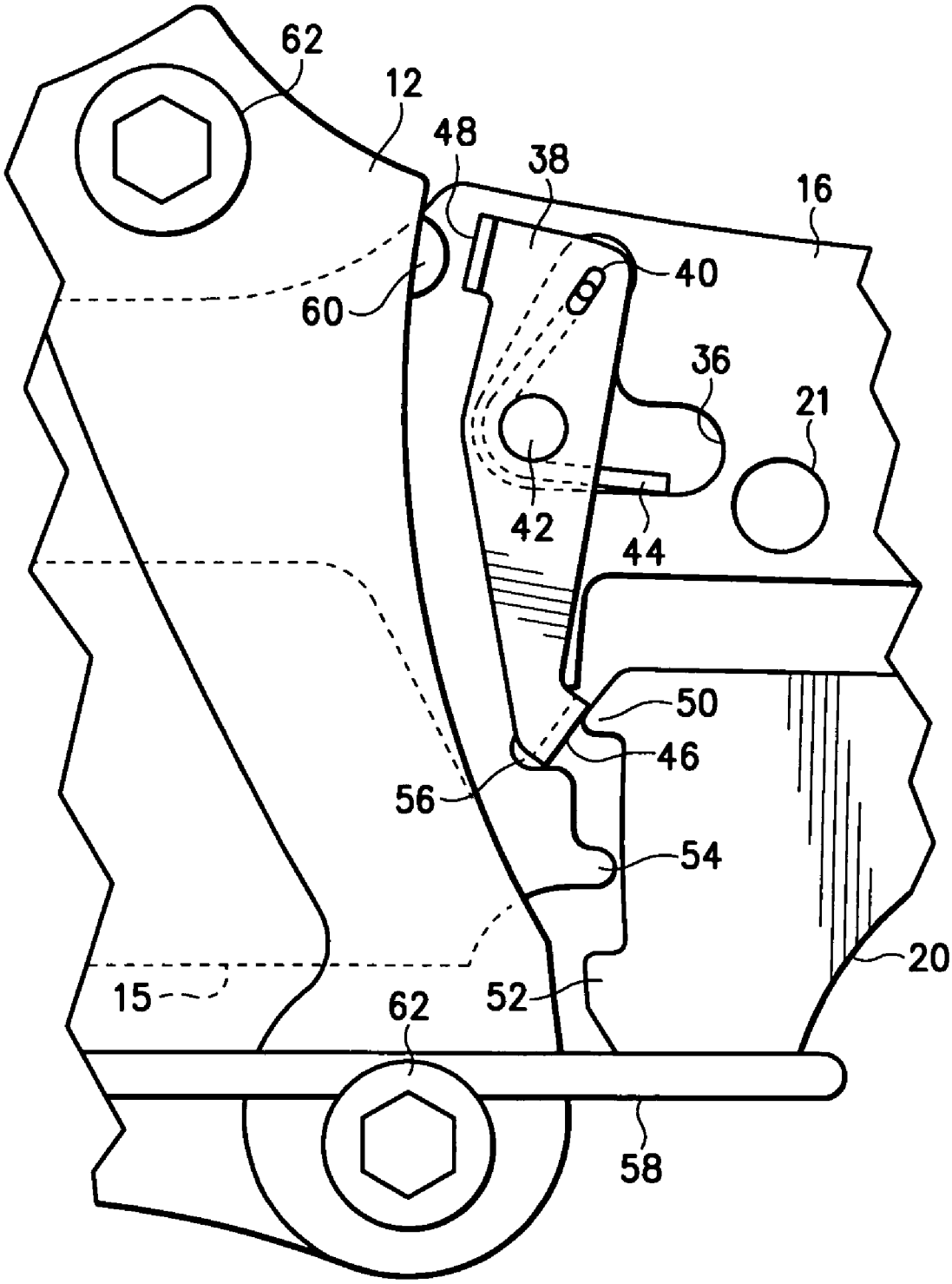
FIG. 6 is a partial cutaway view of the central portion of the locking knife and sheath of FIG. 1, showing a release lever in transition between being locked within the handle cavity and extended out of the handle.

As seen in FIGS. 4-6, the medial section of the blade, or rather where the blade 15 transitions into the blade tang 16, a lock spring cavity 36 is cut for receiving a lock spring 44 and for providing a spring resistance surface. The spring and spring cavity are not limited to the shapes and types of springs shown, but can be modified to include coil springs, compression springs, leaf springs and so forth. The lock spring 44 pivots around a lock spring resistor 42, with one end of the lock spring 44 resting on the surface of the lock spring cavity 36, and the other end extending into a spring receiving slot 40 of a lock spring plate 38. In this configuration then, the lock spring plate 38, which also rotates around lock spring resistor 42, is urged to rotate in the counterclockwise direction according to the representative FIGS.

The lock spring plate 38 contains a sheath interface plate 48 that interacts with the interface plate protrusion 60 on sheath 12 when the knife 10 is inserted into the sheath, the interaction resulting in the lock spring plate 38 being rotated clockwise, against the resistance of the lock spring 44. A spring release catch 46 is located on the other end of the lock spring plate 38, and interacts with an upper spring release protrusion 50 on the medial end of the spring release lever 18. As shown in FIG. 6, when the spring release lever 18 is partially rotated in a clockwise motion around spring release axle 26, the upper spring release protrusion 50 contacts the spring release catch 46, and due to geometry will rotate the lock spring plate 38 in a clockwise direction around the lock spring resistor 42. As the spring release lever 18 continues in the clockwise rotation, the upper spring release protrusion 50 will pass the spring release catch 46, thereby allowing the lock spring 44 to rotate the lock spring plate 38 counterclockwise back to its resting position. In this position, the upper spring release protrusion 50 then rests upon the spring release catch 46, and holds the spring release lever 18 in a locked position demonstrated in FIG. 4 such that the spring release lever 18 is held substantially within the confines of the scales 14 as shown in FIG. 1, to form a gripping surface on the handle that is unobstructed by the spring release lever 18. In this configuration, then, the knife 10 can be extracted from the sheath 12 for use by the operator.

When the knife 10 is inserted back into the sheath 12, the interface plate protrusion 60 of the sheath 12 contacts the sheath interface plate 48 of the lock spring plate 38, and causes it to rotate clockwise around the lock spring resistor 42 and against the resistance provided by lock spring 44. This, in turn, rotates the spring release catch 46 away from upper spring release protrusion 50 and into a spring catch void 56, thereby allowing the spring release lever 18 to rotate counterclockwise around the spring release axle 26 until the upper spring release protrusion 50 contacts and rests upon blade lock protrusion 54. At this point, the medial end of a textured grip 20 of the spring release lever 18 interacts with a spring catch 58, thereby holding the knife 10 securely in the sheath 12, as shown in FIG. 5. After the spring release lever 18 has in effect been released to rotate counterclockwise and engage the spring catch 58, the lock spring 44 will rotate the spring plate 38 back to its unbiased position. It should be noted that the sheath interface plate 48 will then attempt to move the knife 10 away from the sheath 12 by pushing on the interface plate protrusion 60, and may be used to exert an axial force between the textured grip 20 and the spring catch 58, thereby assisting in securing the knife to the sheath. In this embodiment, the spring catch 58 may be a stiff wire forming a loop that surrounds the textured grip. Alternatively, however, the sheath interface plate could be placed on the handle of the knife such that the user could use a finger to release the upper spring release protrusion from the spring release catch. This type of locking mechanism provides the added benefit that it holds the knife securely, regardless of the orientation of the knife and/or sheath. The sheath, for example, could be oriented such that the opening for receiving a knife blade is facing upward in a configuration commonly worn on a belt. Alternatively, the sheath could be attached to the body in the chest region with the sheath opening facing downward, or attached to a leg where in scuba diving applications the knife may be inverted in any numbers of ways.

Although the embodiment shown includes only one interface plate protrusion on the sheath, and interacting with one lock spring plate, the invention could optionally have multiple such protrusions to interact with one or more lock spring plates. Similarly, the embodiment shown has the interface plate protrusion and the lock spring plate on the top of the sheath and knife respectively, it may be located at any point where the sheath and knife could interact and enable the knife to lock into the sheath. The spring release and spring catch are also not limited by the location or by numbers. Indeed, multiple spring releases and spring catches could be utilized, such as one on the top and another on the bottom of the knife and sheath respectively, or perhaps from each of the scales, for example.

Spring catch 58 is shown as a metal bar that extends outward from the medial end of the sheath, but could optionally be molded as part of the sheath in any suitable material such as sheet metal, plastic, glass-filled nylon and so forth, and my be in the shape shown, or converted to other shapes such as an cup shape that holds the medial portion of the textured grip.

Although the example shown is a knife and sheath combination, the principles taught may also be applied to other hand tools ranging from screwdrivers to cameras where it is desired to secure an item in a sheath or similar protective or storage case, but be unimpeded by the locking mechanism when the tool is extracted.

Many modifications and other embodiments of the invention set forth herein will come to mind to one skilled in the art to which this invention pertains having the benefit of the teachings presented in the foregoing description and associated drawings. Therefore, it is to be understood that modification and other embodiments are intended to be included within the scope of the appended claims. Although specific terms are employed herein, they are used in a generic and descriptive sense only, and not for purposes of limitation.

The invention claimed is:

1. A locking sheath and knife combination comprising:

a knife having a blade and a tang;

at least one scale attached to the tang, thereby forming a handle;

at least one lock spring plate substantially enclosed within the handle, the lock spring plate having at least one sheath interface for interacting with a sheath and being capable of interacting with a spring release; and a sheath for receiving at least a part of the knife blade and containing at least one interface plate protrusion and at least one spring catch, wherein the spring release can interface with the spring catch to secure the knife to the sheath, and wherein the spring release can be held substantially within the handle by the lock spring plate.

2. The locking sheath and knife combination of claim 1, wherein the spring release is mechanically biased to move at least partially out of the handle.

3. The locking sheath and knife combination of claim 1, wherein the spring release at least partially rotates about a spring release axle.

4. The locking sheath and knife combination of claim 1, wherein the spring release further comprises a spring release protrusion, the spring release protrusion being capable of interacting with the lock spring plate such that the lock spring plate holds the spring release substantially within the handle when the knife is extracted from the sheath.

5. The locking sheath and knife combination of claim 1, wherein the spring catch is a wire forming a loop that surrounds at least a portion of the spring release when the spring release is extended at least partially out from the handle.

* * * * *